US006796422B1

(12) United States Patent
Lu

(10) Patent No.: US 6,796,422 B1
(45) Date of Patent: Sep. 28, 2004

(54) EYEGLASS CASE

(75) Inventor: Wei-Xiong Lu, Guangzhou (CN)

(73) Assignee: Bae Her Industrial Corp., Tainan (TW)

( * ) Notice: Subject to any disclaimer, the term of this patent is extended or adjusted under 35 U.S.C. 154(b) by 0 days.

(21) Appl. No.: 10/635,987

(22) Filed: Aug. 7, 2003

(51) Int. Cl.[7] ..... A45C 11/04
(52) U.S. Cl. ..... 206/6; 206/818; 220/829
(58) Field of Search ..... 206/516, 818; 220/4.22, 4.28, 4.33, 827, 829, 845

(56) References Cited

U.S. PATENT DOCUMENTS 2,376,487 A * 5/1945 Roland ..... 206/6
2,433,483 A * 12/1947 Root Jr. ..... 206/6
4,150,779 A * 4/1979 Hilbrands ..... 220/829
4,452,373 A * 6/1984 Pearce et al. ..... 220/829
6,574,834 B2 * 6/2003 Fedon ..... 206/6
6,726,004 B2 * 4/2004 Watson ..... 206/6

* cited by examiner

*Primary Examiner*—Luan K. Bui
(74) *Attorney, Agent, or Firm*—Nikolai & Merserau, P.A.

(57) ABSTRACT

An eyeglass case comprises a cover including a lengthwise first groove along one side, a lengthwise second groove adjacent and parallel to the first groove, and a lengthwise third groove along the other side; a body including a lengthwise ridge along one side pivotably fitted in the first groove, a lengthwise fourth groove below the ridge, a lengthwise member having a section of V between the ridge and the third groove, and a lengthwise fifth groove along the other side; two side members releasably coupled to the cover and the body, each side member having an interior recess for facilitating of closing the cover onto the body; and two snapping members each having a section of C, a top end clung in the second groove, and a bottom end clung in the third groove for pivotably securing the cover to the body.

6 Claims, 2 Drawing Sheets

EYEGLASS CASE

BACKGROUND OF THE INVENTION

1. Field of the Invention

The present invention relates to cases and more particularly to an eyeglass case with improved characteristics.

2. Description of Related Art

A conventional eyeglass case comprises a main body and a cover having one side hingedly coupled to one top side of the main body and the other side being capable of connecting to the other top side thereof for closing the case by snapping. However, it has a drawback of being difficult in assembling the case. Further, its manufacturing cost is relatively high. Thus, continuing improvements in the exploitation of eyeglass case are constantly being sought.

SUMMARY OF THE INVENTION

It is an object of the present invention to provide an eyeglass case, comprising a cover including a lengthwise first groove along one side, a lengthwise second groove adjacent and parallel to the first groove, and a lengthwise third groove along the other side; a main body including a lengthwise ridge along one side, the ridge being pivotably fitted in the first groove, a lengthwise fourth groove below the ridge, a lengthwise member having a section of V between the ridge and the fourth groove, and a lengthwise fifth groove along the other side; two side members each including two opposite lateral bars snugly fitted in the fourth and fifth grooves respectively, and an interior recess adjacent one outer bar so as to facilitate of closing the cover onto the main body by engaging the third groove with the fifth groove; and two snapping members each having a section of C, a top end clung in the second groove, and a bottom end clung in the third groove so as to pivotably secure the cover to the main body.

In one aspect of the present invention, a first magnetic material is formed along the third groove and a second magnetic material is formed along the fifth groove so that the first magnetic material is adapted to attract the second magnetic material in response to closing the eyeglass case by engaging the cover with the main body.

In another aspect of the present invention each of the cover, the main body, and the side members is formed of aluminium alloy or ABS (acrylonitrile-butadiene-styrene).

In a further aspect of the present invention, electroplating is done on an outer surface of the eyeglass case.

The above and other objects, features and advantages of the present invention will become apparent from the following detailed description taken with the accompanying drawings.

DETAILED DESCRIPTION OF THE PREFERRED EMBODIMENTS

Figure 1:
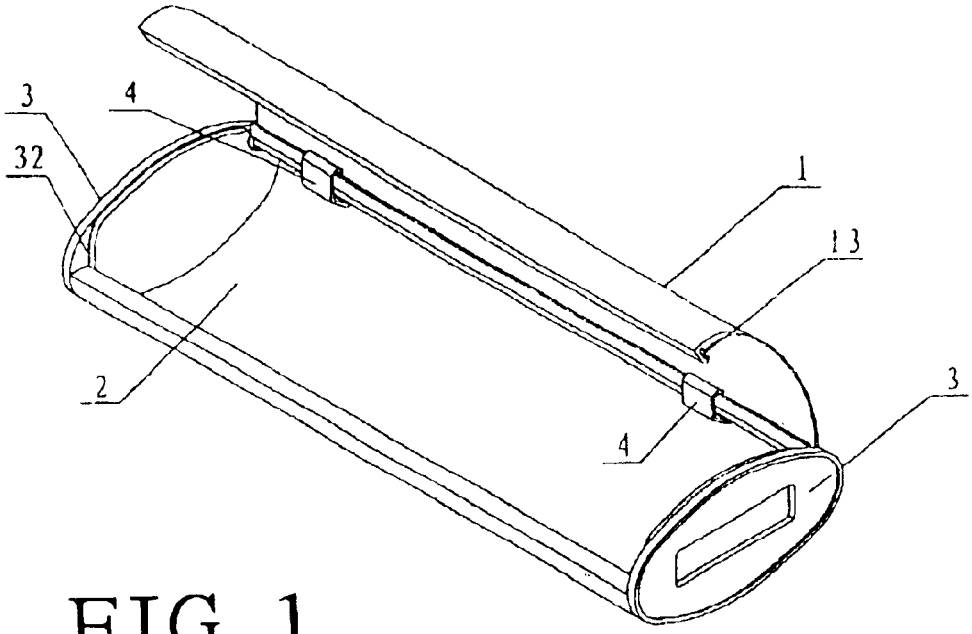
FIG. 1 is a perspective view of a preferred embodiment of eyeglass case according to the invention.
Figure 2:
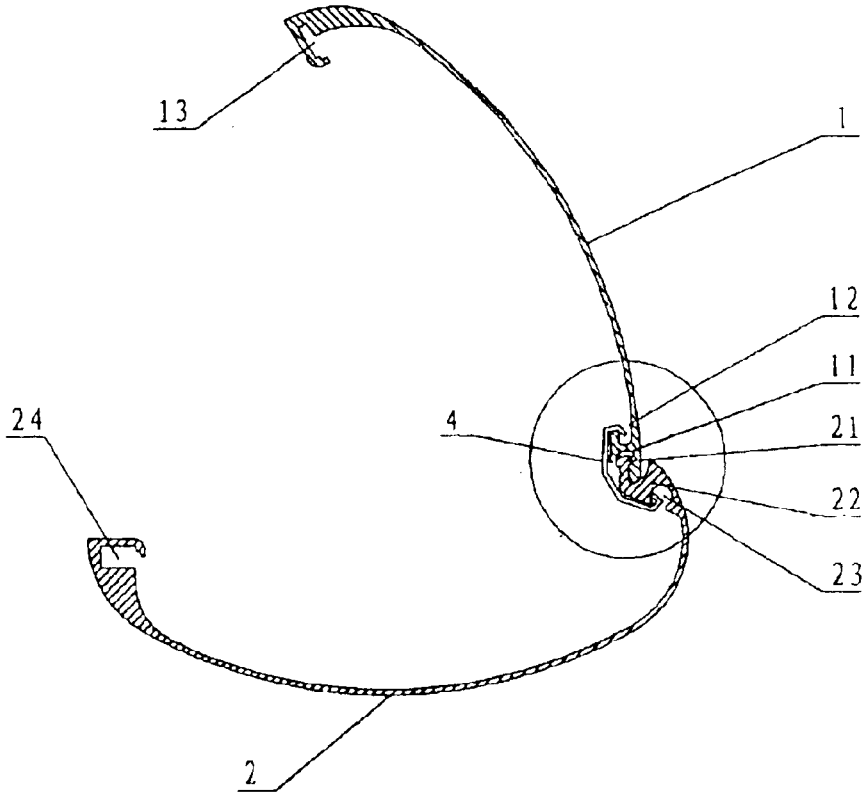
FIG. 2 is a cross-sectional view of FIG. 1.
Figure 3:
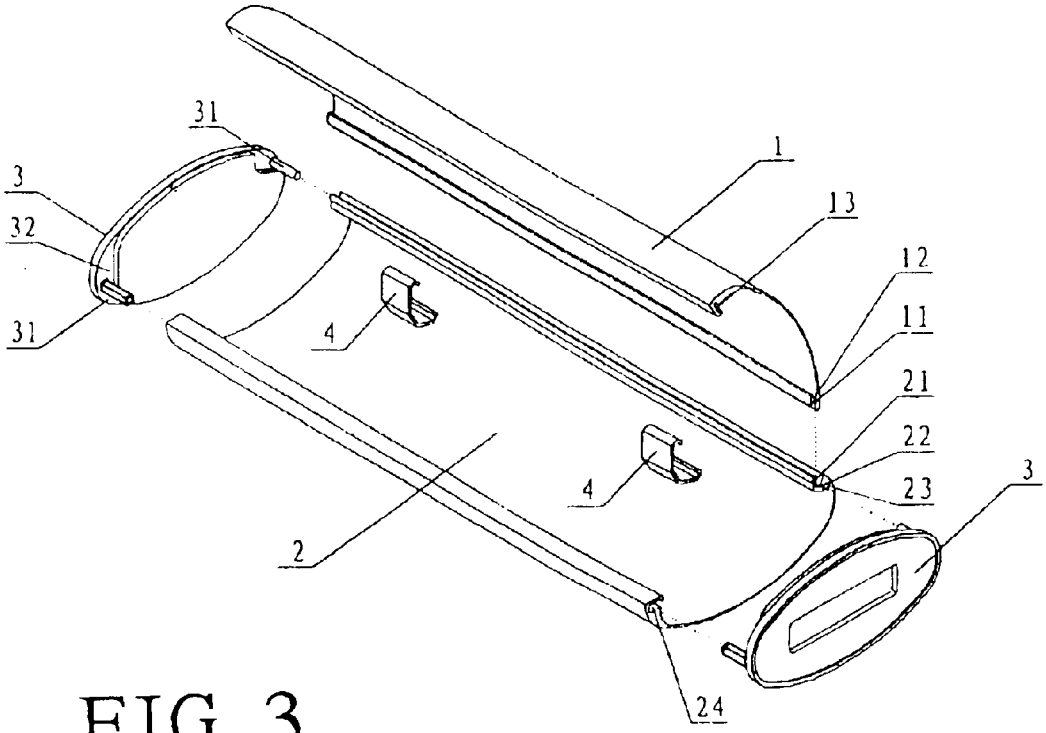
FIG. 3 is an exploded view of FIG. 1.
Figure 4:
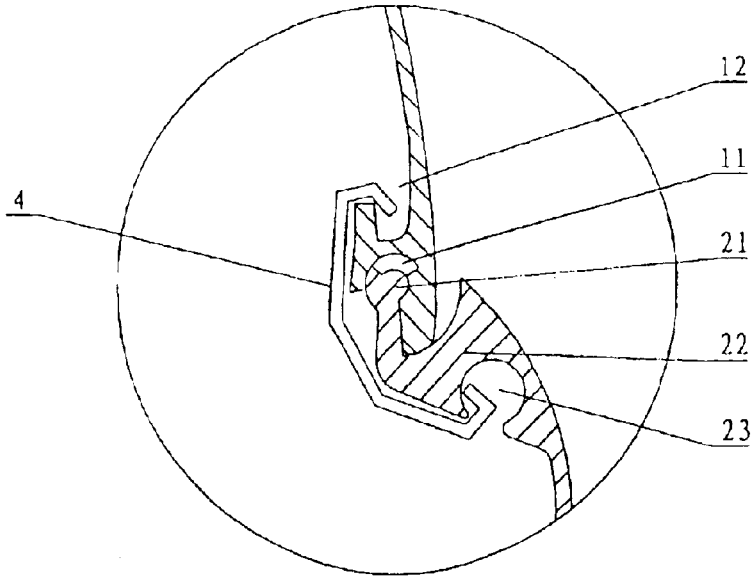
FIG. 4 is a detailed view of the area in a circle shown in FIG. 2.

Referring to FIGS. 1 to 4, there is shown a case for storing a pair of eyeglasses in accordance with the invention. The case comprises a cover 1, a main body 2, two side members 3, and two elastic snapping members 4. Each component will be described in detail below.

The cover 1 comprises a lengthwise first groove 11 along one side, a lengthwise second groove 12 adjacent and parallel to the first groove 11, and a lengthwise third groove 13 along the other side in which a magnetic material is formed therealong. The main body 2 comprises a lengthwise ridge 21 along one side, the ridge 21 being pivotably fitted in the first groove 11, a lengthwise fourth groove 23 below the ridge 21, a lengthwise member 22 having a section of V between the ridge 21 and the fourth groove 23, and a lengthwise fifth groove 24 along the other side in which a magnetic material is formed therealong. Each side member 3 is of oval shape and comprises two opposite lateral bars 31 snugly fitted in the grooves 23 and 24 respectively, and an interior recess 32 adjacent one outer bar 31 so as to facilitate of closing the cover 1 onto the main body 2 by engaging the third groove 13 with the fifth groove 24. The snapping member 4 has a section of C. A top end of the snapping member 4 is clung in the second groove 12 and a bottom end thereof is clung in the fourth groove 23. As such, the hinge connection of the cover 1 and the main body 2 is secured for permitting a pivoting of the cover 1 about the main body 2 to open or close the case. Moreover, once the main body 2 is closed by the cover 1, the magnetic material formed along the third groove 13 can attract the magnetic material formed along the fifth groove 24 for securing the closing. To the contrary, a suitable force can be applied on the cover 1 to open the case by overcoming the magnetic force.

Preferably, the cover 1, the main body 2, and the side members 3 are formed of aluminium alloy for reducing weight. Alternatively, the cover 1, the main body 2, and the side members 3 are formed of ABS (acrylonitrile-butadiene-styrene) also for reducing weight. Further, electroplating can be done on the outer surface of the case for aesthetic purpose. Furthermore, a soft material such as pad or soft cloth can be formed on the interior surface of the main body 2 for the protection of eyeglasses.

While the invention herein disclosed has been described by means of specific embodiments, numerous modifications and variations could be made thereto by those skilled in the art without departing from the scope and spirit of the invention set forth in the claims.

What is claimed is:

1. An eyeglass case, comprising:

a cover including a lengthwise first groove along one side, a lengthwise second groove adjacent and parallel to the first groove, and a lengthwise third groove along the other side;

a main body including a lengthwise ridge along one side, the ridge being pivotably fitted in the first groove, a lengthwise fourth groove below the ridge, a lengthwise member having a section of V between the ridge and the fourth groove, and a lengthwise fifth groove along the other side;

two side members each including two opposite lateral bars snugly fitted in the fourth and fifth grooves respectively, and an interior recess adjacent one outer bar so as to facilitate of closing the cover onto the main body by engaging the third groove with the fifth groove; and two snapping members each having a section of C, a top end clung in the second groove, and a bottom end clung in the fourth groove so as to pivotably secure the cover to the main body.

2. The eyeglass case of claim 1, further comprising a first magnetic material formed along the third groove and a second magnetic material formed along the fifth groove.

3. The eyeglass case of claim 2, wherein the first magnetic material is adapted to attract the second magnetic material in response to closing the eyeglass case by engaging the cover with the main body.

4. The eyeglass case of claim 1, wherein each of the cover, the main body, and the side members is formed of aluminium alloy.

5. The eyeglass case of claim 1, wherein each of the cover, the main body, and the side members is formed of ABS (acrylonitrile-butadiene-styrene).

6. The eyeglass case of claim 1, further comprising electroplating an outer surface of the eyeglass case.

* * * * *